United States Patent [19]

Hart

[11] Patent Number: 4,738,242

[45] Date of Patent: Apr. 19, 1988

[54] DOOR LOCK DEFROSTER

[76] Inventor: William J. Hart, 14 Pinehurst Ave., Albany, N.Y. 12203

[21] Appl. No.: 23,138

[22] Filed: Mar. 9, 1987

[51] Int. Cl.[4] ..... F23C 5/00

[52] U.S. Cl. ..... 126/271.1; 126/271.2 R; 126/110 B; 431/344; 432/222

[58] Field of Search ..... 126/271.1, 271.2 R, 126/110 B; 431/344, 345; 432/222

[56] References Cited

U.S. PATENT DOCUMENTS

| | | | |
|---|---|---|---|
| 159,820 | 2/1875 | Harris, Jr. | 432/222 |
| 863,464 | 8/1907 | Straube | 432/222 |
| 1,606,390 | 11/1926 | Schmuck | 432/222 |
| 2,780,218 | 2/1957 | Allen | 126/271.2 R |
| 2,990,829 | 7/1961 | McDonough et al. | 126/271.2 R |
| 3,248,133 | 4/1966 | Michnoff | 126/271.1 |
| 3,809,527 | 5/1974 | Newman | 126/271.1 |
| 3,816,061 | 6/1974 | Guth | 431/352 |
| 3,917,442 | 11/1975 | Zagoroff | 431/351 |
| 4,063,876 | 12/1977 | Schweiss | 431/344 |

*Primary Examiner*—James C. Yeung

*Attorney, Agent, or Firm*—Heslin & Rothenberg

[57] ABSTRACT

A motor vehicle door lock defroster attachment is disclosed for use in defrosting frozen door linkage mechanisms. The device includes a flexible radially corrugated tube having an attachment end shaped to engage the nozzle of a portable gas torch and a tapered discharge end positionable within the elongated space defined by the vehicle's door and door jamb. When the attachment end has been connected to the torch nozzle and the discharge end positioned in the door space in the vicinity of the frozen door linkage mechanism, heated air will move through the tube and out the discharge end thereby warming and defrosting the frozen mechanism. In an operational embodiment of the invention, the defroster apparatus also includes a base which will adjustably grip the torch tank such that the tank is maintained in a substantially vertical orientation, and magnetic stripping which, when applied over the door space above and below the point of air infusion, will maintain the infused heated air in the general vicinity of the frozen linkage mechanism.

9 Claims, 2 Drawing Sheets

DOOR LOCK DEFROSTER

BACKGROUND OF THE INVENTION

1. Technical Field

The present invention generally relates to defroster device and more specifically, to a motor vehicle door lock defroster attachment for use with portable torches such as a propane gas torch.

2. Background Art

During periods of very cold weather, it is not unusual for door linkage mechanisms, such as those found on motor vehicles, to freeze in a closed or locked position due to ice build-up in the vicinity of the mechanism, thus rendering the interior of the vehicle inaccessible to an owner or operator. Locksmiths are generally able to free the frozen linkage mechanism by thawing the surrounding ice with known chemical solvents. However, as the elongated space between a motor vehicle door and door jamb is usually quite narrow, it is often difficult to apply such solvents directly to the linkage mechanism. Also, in very cold and windy weather, such solvents are often rendered incapable of sufficiently thawing the ice so as to free the mechanism from its latched or locked position. In these extreme cases, it is usually necessary to resor to towing the vehicle to a heated garage where the linkage will thaw gradually. Such measures are both costly and inconvenient to the owner of the vehicle.

Therefore, there presently exists a genuine need for an inexpensive, dependable, portable and relatively rapid means for defrosting door linkage mechanisms in below freezing weather.

Attachments for gas torches and other heating devices have previously been deployed inthe creation of heaters for general space heating (U.S. Pat. No. 4,063,876), and more specifically for the heating of automobile oil pans (U.S. Pat. No. 3,809,527) and tires (U.S. Pat. No. 159,820). Such devices, however, are uniformly designed to provide heat over a general area and are not readily adaptable for the provision of directed heat to a specific interior automotive mechanism. Additionally, these devices neither address nor solve specific problems inherent in applying heat to an internal motor vehicle linkage mechanism, such as the possibility of heat damage to the surrounding exterior of the vehicle.

SUMMARY OF THE INVENTION

The above described need is satisfied and limitations of the prior art overcome, in accordance with the present invention, by the provision of a device or attachment intended to be connected to a heat source. The device includes a tube having an attachment end and a discharge end. The attachment end is shaped to engage a heat source such as a gas torch and the discharge end is shaped so as to be positionable in the elongated space between a door and door jamb. When the attachment end has been connected to the heat source and the discharge end positioned in the space defined by the door and door jamb in the vicinity of the frozen door linkage mechanism, heated air will move through the device and out the discharge end thereby warming and defrosting the frozen mechanism.

As a further embodiment of the present invention, defrosting apparatus is provided in which the above device consists of a metallic tube having a series of radial corrugations positioned along its length which provide transfer of excess heat to the ambient atmosphere and flexibility to the tube. The attachment end of the tube is constructed to engage the nozzle of a torch such that the torch flame resides within the tube. At least one first hole is provided adjacent the attachment end for maintaining airflow to a torch flame and a second hole, larger than the first hole, is positioned adjacent the attachment end so that the torch may be lit therethrough. The discharge end is tapered to form a slotted discharge opening and thereby facilitate positioning of the device within the elongated space defined by the door and door jamb. The defrosting apparatus also include a base capable of adjustably holding the torch in a fixed position and sealing means for temporarily enclosing the elongated space defined by the door and the door jamb in the vicinity of the door linkage mechanism to maintain any heated air discharged from the tube therein.

Accordingly, a primary object of the invention is to provide an inexpensive, reliable, and portable means for defrosting motor vehicle door linkage mechanisms in extremely cold weather.

Another object of the present invention is to provide an adjustable motor vehicle door lock defroster attachment readily positionable in the immediate vicinity of a frozen motor vehicle door linkage mechanism.

A further object of the invention is to provide an automotive door lock defroster attachment which will function effectively and efficiently without causing cosmetic damage to the exterior of the vehicle.

BRIEF DESCRIPTION OF THE DRAWINGS

These and other objects, features, and advantages of the invention will become more fully apparent from the following detailed description of illustrative embodiments when read in conjunction with the accompanying drawings in which.

DETAILED DESCRIPTION

Figure 1:
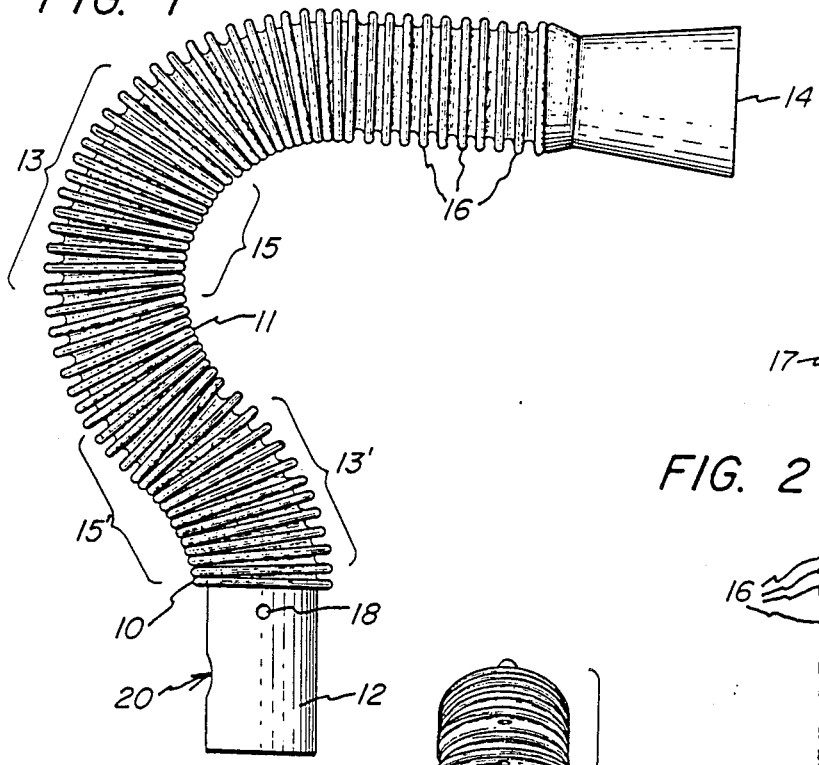
FIG. 1 is a side elevational view of a torch attachment of the present invention.

Referring now to the drawings, FIG. 1 shows a side view of the defroster attachment 10, preferrably constructed from a relatively inexpensive metal able to withstand concentrated heat. Attachment 10 includes a main body or tube 11, an attachment or securement end 12, connectable to the nozzle of a gas torch (not shown), and a tapered discharge end 14, positionable within the elongated space defined between a door and door jamb. When a torch is connected to attachment 10 at attachment end 12 and ignited, the resultant heated air from the torch flame moves forwardly through the tube 11 and is forced out through discharge end 14 and into the elongated door space, sufficiently defrosting the linkage mechanism so that the door may be unlocked and opened.

Figure 2:
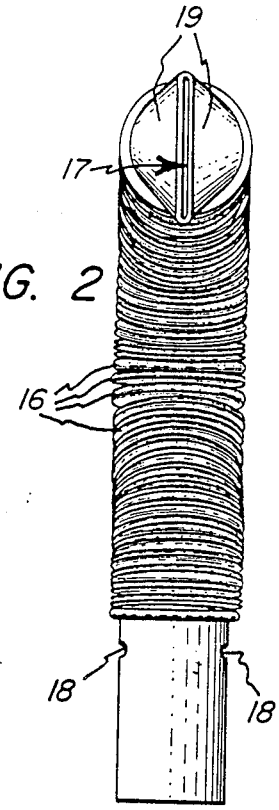
FIG. 2 is an end view taken substantially along the line 2—2 of FIG. 1.

FIG. 2 illustrates a frontal view of the discharge end 14 showing tapered sides 19 narrowing into a slotted opening 17. The tapered sides 19 of the discharge end 14 facilitate both positioning the attachment 10 within the narrow space defined by the door and door jamb and the concentrated application of heated air to a frozen linkage mechanism through acceleration of the air as it is forced through the slotted opening 17.

Attachment 10 is also provided with radial corrugations 16 along the length of tube 11. It has been observed that winter days and night are often characterized by strong wind gusts which have a tendency to extinguish the torch flame unless the flame is increased to maximum output. The resultant intense heat can cause damage to the plastic molding and paints of many vehicles. Thus, radial corroguations 16 are included to provide increased surface area for conduction of excess damaging heat to the ambient atmosphere. Corrugations 16 also serve the dual purpose of providing flexibility to attachment 10 such that it may be accurately positioned relative to a vehicle's door space. In the preferred embodiment, tube 11 of attachment 10 is bent into two distinct angles, a and b, angle a having an upper angled surface 13 and a lower angled surface 15 and angle b having an upper angled surface 13' and a lower angled surface 15' such that the attachment assumes a serpentine configuration. Such a configuration allows the discharge end 14 to be positioned where needed while the attachment end 12 is connected to a vertically oriented torch tank nozzle. Additionally, the serpentine shape facilitates deflection of the torch flame off the inner walls of the attachment 10 thus preventing said flame from extending through the tube 11 and causing heat damage to the exterior of the vehicle.

As best shown in Figure, 1 the attachment 10 additionally has a plurality of radially positioned first holes 18 adjacent the attachment end 12 for maintaining air flow to a torch flame while the torch is ignited. In a preferred embodiment, there are two first holes 18 which are positioned on an axis perpendicular to the direction of the discharge end 14. Thus, should any flames escape through the first holes 18, they will be directed out parallel to the surface of the vehicle, thus avoiding damage to the vehicle's exterior. A larger second hole 20 is positioned between the plurality of first holes 18 and the attachment end 12 to allow for lighting of a gas torch therethrough subsequent to connection of the torch to the attachment end 12. If aperture 20 provides sufficient air flow to maintain the torch flame, holes 18 may be eliminated.

Figure 3:
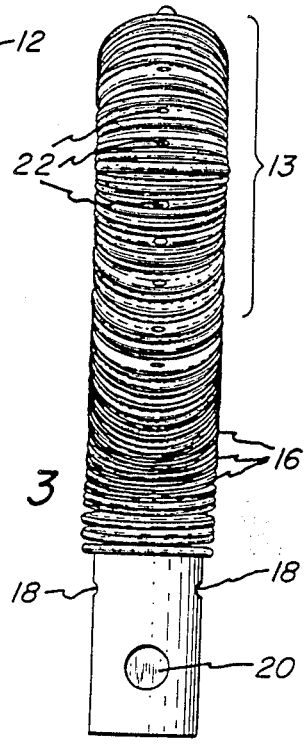
FIG. 3 is an end view taken substantially along the line 3—3 of FIG. 1.

FIG. 3 illustrates a series of optional apertures 22 running longitudinally along the upper angled surface 13 of the tube 11. Such apertures 22 allow for additional heat transfer to the ambient atmosphere should the corregations 16 prove insufficient due to the necessity of a very high degree of heat.

Figure 4:
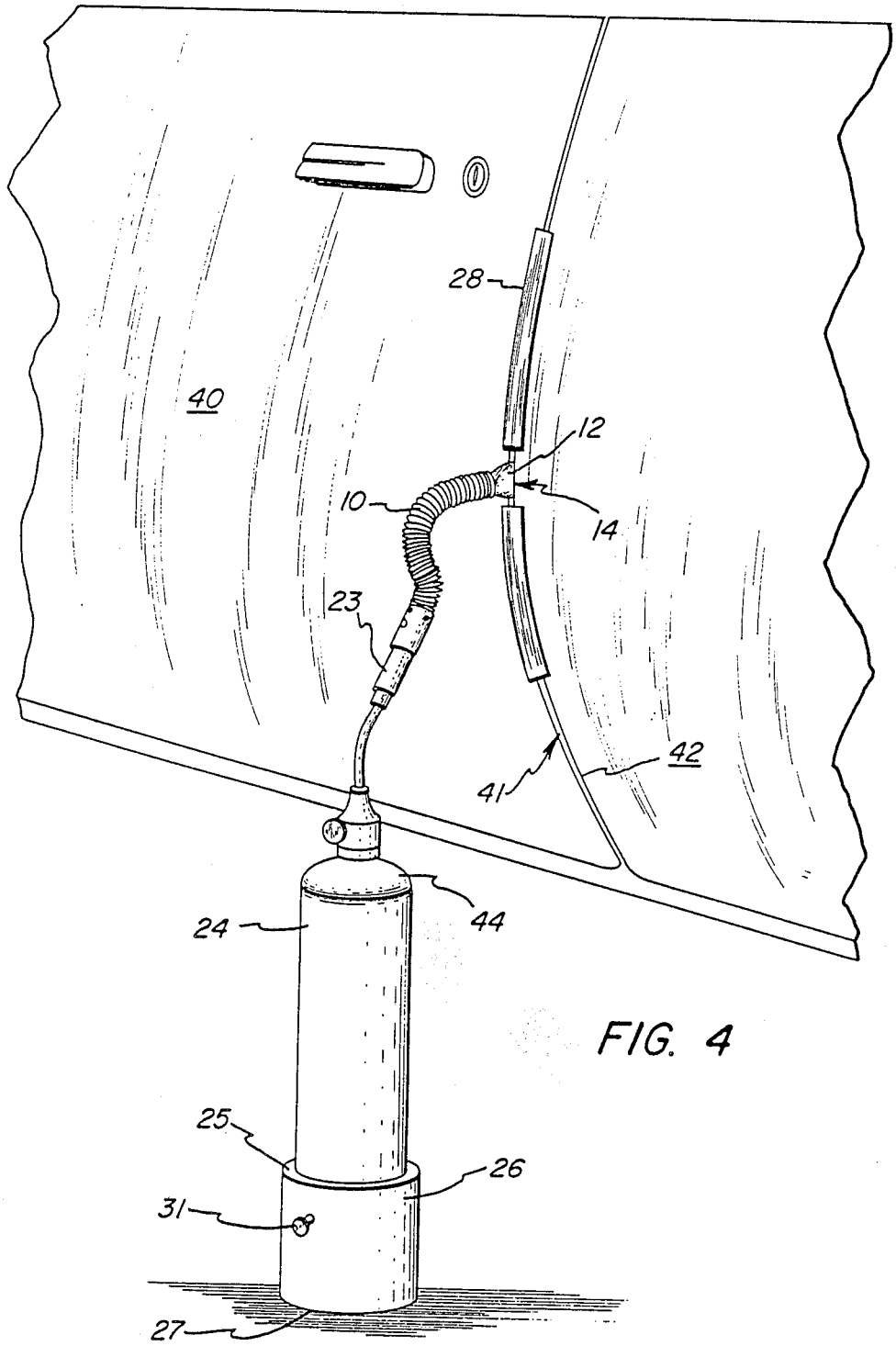
FIG. 4 is a perspective view of defrosting apparatus, constructed in accordance with the principles of the invention, being used to defrost a vehicle door linking mechanism.

A further operational embodiment of the present invention is shown in FIG. 4. As shown, defroster attachment 10 is positioned with its attachment end 12 connected to a nozzle 23 of a torch 44, and its discharge end 14 situated in the space 41 between the motor vehicle door 40 and door jamb 42. The torch tank 24 is held upright within a base 26. The base 26 has an upper end 25 and a lower end 27. The lower end 27 is adapted to sit on the ground or any other substantially horizontal surface. Upper end 25 has an opening sized to accomodate torch tank 24. Base 26 includes a thumb screw adjustment 31 which allows vertical adjustment of tank 24 relative to base 26. Alternatively, upper end 25 may be constructed of a material which securetly yet adjustably grips the sides of the torch tank 24 such that the tank 24 can be maintained at various desired heights within the base 26. Further, it is preferable that the base 26 be constructed a material which is also lightweight, inexpensive and relatively easy to transport and use. In the preferred embodiment, the base 26 is also brightly colored such that, e.g., should it be dropped into a snowbank, it can easily be recovered.

When torch 44 is lit, the heated air released from the discharge end 14 into the door space 41 is maintained in the general vicinity of the frozen linkage mechanism by the application of magnetic stripping 28 over the door space 41 above and below the point of air infusion. Such magnetic stripping 28 is especially desirable as a sealing means as it is easily applied to the vehicle and may be removed without causing cosmetic damage to the exterior surface of the vehicle.

From the foregoing, it will be apparent that an automotive door lock defroster has been devised that is inexpensive, convenient and dependable in use. The apparatus may be used even in the coldest weather and provides a quick and relatively inexpensive means for defrosting a frozen automotive linkage mechanism. It being understood that the invention as above described is not limited to the details disclosed but includes such variations and modifications as fall within the spirit of the invention and the scope of the appended claims.

I claim:

1. Apparatus for defrosting a frozen door linkage mechanism, said door linkage mechanism being capable of maintaining a door in a latched or locked position relative to a door jamb, said apparatus comprising:

a torch having a tank and a nozzle;

a radially corrugated metallic attachment, said attachment having a securement end and a discharge end, said securement end shaped to engage the nozzle of said torch such that when lit the flame from said torch resides within said attachment, said attachment having at least one first hole adjacent said securement end for maintaining air flow to said torch flame, said attachment also having a second hole adjacent said securement end, said second hole being larger than said at least one first hole and positioned such that said torch may be lit therethrough when said attachment is secured to said torch, said discharge end tapered to form a slotted discharge opening, said tapering facilitating positioning of said discharge end within the elongated space defined by the door and the door jamb in the vicinity of the frozen door linkage mechanism said corrugations providing transfer to the ambient atmosphere of excess heat eminating from the flame of said torch flame and flexibility to said attachment for positioning said discharge end as needed;

a base having an upper end and a lower end, said upper end being shaped to engage and hold said torch tank such that when said lower end is positioned on a substantially horizontal surface said torch tank is positioned and maintained in a substantially vertical orientation, said torch nozzle being elevated above said torch tank; and temporary sealing means for partially sealing said elongated space between the door and the door jamb in the vicinity of the frozen door linkage mechanism for maintaining heated air discharged from said attachment therein.

2. The apparatus of claim 1, wherein said door and door jamb are metallic and said sealing means comprises magnetic stripping capable of detachably adhering to the said door and door jamb.

3. The apparatus of claim 1, wherein said upper base end adjustably engages said torch tank such that said torch may be maintained at various heights relative to said horizontal surface upon which said base rests.

4. A device connectable to a torch for use in defrosting a frozen door linkage mechanism, said door linkage mechanism being capable of maintaining a door in a latched or locked position relative to a door jam, said device comprising:

a flexible metallic tube having an attachment end and a discharge end, said attachment end being shaped to engage the nozzle of the torch such that the flame from the torch resides within the tube, said discharge end being tapered to a slotted opening so as to be positionable within the elongated space defined by the door and the door jam in the vicinity of the frozen door linkage mechanism, said tube having radial corrugations, said corrugations functioning to provide transfer of excess heat eminating from the torch flame within the tube to the ambient atmosphere and to provide flexibility to said tube, said tube also having at least one first hole adjacent said attachment end for maintaining air flow to said torch flame and a second hole larger than said at least one first hole positioned such that said torch may be lit therethrough, whereby when said discharge end is positioned in the vicinity of the frozen door linkage mechanism within the space defined by the door and the door jam, air heated by the torch flame will move through said tube and out the discharge end to warm and defrost the door linkage mechanism.

5. The defrosting device as recited in claim 4, wherein said cylindrically shaped tube has a plurality of apertures longitudinally positioned along said tube to allow for additional release of excess generated heat to the ambient atmosphere.

6. The defrosting device as recited in claim 5, wherein said cylindrically shaped tube is bent so as to have a lower angled surface and an upper angled surface, said plurality of apertures being longitudinally positioned along said upper angled surface.

7. A device connectable to a torch for use in defrosting a frozen door linkage mechanism, said door linkage mechanism being capable of maintaining a door in a latched or locked position relative to a door jam, said device comprising;

a metal tube of serpentine configuration having an attachment end and a discharge end, said attachment end being shaped to engage the nozzle of said torch such that the flame from the torch resides within the said tube, said serpentine configuration facilitating deflection of the flame against the inner walls to the tube so as to prevent said flame from extending through the tube, said discharge end being tapered to a discharge opening said tapering allowing the discharge end to be positionable within an elongated space defined by the door the door jam in the vicinity of the frozen door linkage mechanism, said tube having radial corrugations, said corrugations functioning to provide transfer of excess heat eminating from the torch flame within the tube to the ambient atmosphere and to provide flexibility to the tube, said tube also having at least one first hole adjacent said attachment end for maintaining air flow to said torch flame, whereby when said discharge end is positioned in the vicinity of a frozen door linkage mechanism within the space defined by the door and the door jam, air heated by the torch flame will move through the tube and out said discharge end, thereby warming and defrosting the door linkage mechanism.

8. The defrosting device as recited in claim 7, wherein said tube is substantially circular shaped in cross section.

9. The defrosting device as recited in claim 8, wherein said tube has a plurality of aperatures longitudally positioned along it to allow for additional release of excess generated heat to the ambient atmosphere.

* * * * *